US005417521A

United States Patent [19]

Scott

[11] Patent Number: 5,417,521

[45] Date of Patent: May 23, 1995

[54] MULTIPLE CABLE ROCK ANCHOR SYSTEM

[75] Inventor: James J. Scott, Rolla, Mo.

[73] Assignee: Scott Investment Partners, Rolla, Mo.

[21] Appl. No.: 148,859

[22] Filed: Nov. 8, 1993

Related U.S. Application Data

[63] Continuation-in-part of Ser. No. 106,888, Aug. 16, 1993, abandoned.

[51] Int. Cl.[6] ..... E21D 20/02; E21D 21/00

[52] U.S. Cl. ..... 405/259.6; 405/259.5; 405/302.1; 411/82

[58] Field of Search ..... 411/82, 392; 405/259.1, 405/259.5, 259.6, 302.1, 288

[56] References Cited

U.S. PATENT DOCUMENTS

| | | | |
|---|---|---|---|
| 3,226,934 | 1/1966 | Emery . | |
| 3,389,561 | 6/1968 | Taylor et al. . | |
| 3,505,824 | 4/1970 | White . | |
| 3,601,994 | 8/1971 | Galis . | |
| 3,913,338 | 10/1975 | Galis . | |
| 3,971,226 | 7/1976 | Morrell . | |
| 4,160,615 | 7/1979 | Baldwin . | |
| 4,247,224 | 1/1981 | Killmeyer | 405/259.5 |
| 4,247,225 | 1/1981 | Chickini et al. | 405/259.1 X |
| 4,303,354 | 12/1981 | McDowell, Jr. . | |
| 4,369,003 | 1/1983 | Brandstetter . | |
| 4,378,180 | 3/1983 | Scott . | |
| 4,477,209 | 10/1984 | Hipkins, Jr. et al. . | |
| 4,518,292 | 5/1985 | Calandra, Jr. . | |
| 4,708,532 | 11/1987 | Leppanen | 405/259.5 X |
| 4,728,219 | 3/1988 | Leppanen | 405/259.1 |
| 4,798,501 | 1/1989 | Spies | 405/259.1 X |
| 5,230,589 | 7/1993 | Gillespie | 405/259.6 |
| 5,253,960 | 10/1993 | Scott | 405/302.2 |
| 5,288,176 | 2/1994 | Huff et al. | 405/259.6 |

FOREIGN PATENT DOCUMENTS

| | | | |
|---|---|---|---|
| 3125166 | 1/1983 | Germany | 405/259.1 |
| 161515 | 6/1992 | Japan | 405/259.1 |
| 899997 | 2/1982 | U.S.S.R. | 405/259.6 |

*Primary Examiner*—Randolph A. Reese
*Assistant Examiner*—John A. Ricci
*Attorney, Agent, or Firm*—Polster, Lieder, Woodruff & Lucchesi

[57] ABSTRACT

A multiple cable rock anchor comprising an assembly of a plurality of individual elongated cables having an attachment for joining a first end of each cable in association for common movement, or wrapped to loosely hold them together without restricting relative sliding movement in bending. The assembly of multiple cable rock anchor being manipulated by bending for installation in a borehole formed in a geologic structure where there is a drift dimension less than the desired length dimension of the elongated cables, thereby forcing the cables to be bent upon being inserted in the borehole. Further, the assembly of cables have different strengths, dimensions and lengths.

18 Claims, 4 Drawing Sheets

MULTIPLE CABLE ROCK ANCHOR SYSTEM

REFERENCE TO THE PRIOR APPLICATION

This application is related to, contains subject matter in common with, and is a continuation-in-part of Ser. No. 08/106,888, filed Aug. 16, 1993 entitled MULTIPLE CABLE ROCK ANCHOR SYSTEM now abandoned.

BACKGROUND OF THE INVENTION

1. Field of the Invention

This invention is directed to a system for resisting and preventing collapse of mine roofs and adjacent sides, and more particularly to multiple cable rock anchors which can be bent to permit longer cable lengths to be installed in low ceiling passages, and which cables can be rotated into position to penetrate and mix the resinous anchor materials.

2. Description of the Prior Art

Several types of anchor bolt systems have been used in the past to provide the support of mine roofs, and to provide long term stability to the system. Typical anchor bolts are seen in U.S. Pat. Nos. 3,226,934 of Jan. 4, 1966, 4,303,354 of Dec. 1, 1981 , 4,378,180 of Mar. 29, 1982 and 4,518,292 of May 21, 1985. Other types of anchor bolts are seen in U.S. Pat. Nos. 4,369,003 of Jan. 18, 1983 and 4,477,209 of Oct. 16, 1984. Rock anchor systems employing cables are shown in U.S. Pat. Nos. 3,913,338 of Oct. 21, 1975 and 4,160,615 of Jul. 10, 1979. Long cables have been used in boreholes to allow placement of anchor cables in the geological material to be mined. These systems essentially presupport the geologic material before mining takes place. In some systems, a cable or cables, with an attached air breather tube, are placed in the borehole to its full depth. The collar of the borehole is sealed around the cables, air breather tube, and a short insertion tube. Cementeous material is pumped through the insertion tube until it flows out of the air breather tube, assuring complete filling of the annulus area around the cable or cables. Cables are not rotated as no mixing of cementeous material is needed. Over a period of time, the cement sets up and the anchored cables serve to stabilize the rock mass. The above described system has been used throughout the world in mining for the past twenty years to stabilize geologic material in and around large excavations underground.

In more recent times, development and use of shorter cable bolts anchored in resinous materials has been employed by the mining industry. Research and development has proceeded rapidly due to the need for longer length rock anchors in the coal industry, particularly to stabilize the rock masses around headgate and tailgate entries associated with longwall mining. Coupled rod rock anchor systems have been used but their cost is high, installation is slow and large diameter boreholes must be used to allow passage of the couplings. For this reason, mine operators are desirous of using cable rock anchors which can be bent to allow longer than seam height, high strength rock anchors to be installed efficiently.

In the soft rock mining industry, coal, salt, potash, etc., it is common practice to rotary drill small diameter boreholes for rock anchors. Coupled large rod high strength anchors require that large diameter boreholes be drilled to provide room for the couplings, rods, and resinous material. Cables are normally four times as strong per unit weight as comparable strength rods. Thus, small boreholes can be used to obtain the same anchor strength. For example, a 0.6 inch diameter, 7-strand cable, in a one inch diameter borehole, resin anchored, is comparable to a one inch diameter solid coupled rod anchor in a 1⅝ inch diameter borehole resin anchored.

Scott, in his U.S. Pat. No. 5,253,960, described a cable bolt for the foregoing application. A single cable is anchored in resinous material and can be quickly placed in lengths longer than seam height. Cable sizes most often used in industry are 7-strand solid wire cables of nominal 0.5 or 0.6 inches in diameter. These cables have near 20 and 30 ton load carrying capacity respectively. They all can be bent manually by a man to a near 4 to 5 foot diameter circle, and this capability allows them to be shipped in coils and manually bent in low seams, say 4 to 5 feet, for insertion into long boreholes. Large diameter individual cables are too stiff for manual handling and have not been used by industry.

To further increase the anchorage, it is desirable to place more than one cable in a single borehole and be able to install it in as small a borehole as possible, and to also install it with existing equipment available in the mining industry. This invention allows the joining of several cables in a bore, wherein the cables are the same or have differing diameters and strengths, using a single unifying attachment device or nut to allow rotation of all cables simultaneously to embed the cables with each other in resinous or cementeous material to provide a higher strength rock anchor than was previously possible. Cables are twisted during insertion to stiffen the system and provide a superior mixing system when rotated into resinous materials.

SUMMARY OF THE INVENTION

It is therefore one of the principle objects of the invention to provide a rigid unifying attachment to the ends of a number of cables in the form of a wedgelike grip unit, which has special features in its design to provide seats for hardened steel wedges, which in turn grips the cable to assure that they will not move or slip on the cables other than enough to fully seat the wedges.

It is a further object of the invention that the rigid attachment device will provide a bearing surface upon which a mine roof plate can be supported to carry geologic loads immediately upon installation.

Another object of the invention is to provide a suitable attachment surface on the rigid attachment to allow connection to be made between the rigid attachment and a suitable rotation motor and mounting to allow complete rotation of the multi-cable rock anchor in the borehole.

Another object of the invention is to use cables of different diameters and strength in the same borehole to provide a safety means to prevent violent blowout of the cables if overload occurs.

Another object of the invention is to provide rigid unifying attachment to the ends of the cables in the form of a tapered cone of poured metal, such as zinc, to form a bond and wedgelike grip on all the cables in a common attachment when the metal hardens.

Another object of the invention is to use cables of selected or slightly different lengths to provide a piercing method by the lead and secondary cables of the resinous cartridges in the borehole to facilitate insertion of the cable and mixing of the resinous materials.

Another object of the invention is to allow several cables to be bent simultaneously for insertion into boreholes where longer cables are needed in a passage formed with low ceiling seam height, and to allow cables to slip relative to each other to allow manual bending.

Another object of the invention is to twist the cable during installation to form a screw-like surface to push or pump resinous material toward the base of the borehole during rotation at the time of installation.

Another object of the invention is to twist the cable upon installation to tighten cables one against the other and stiffen and make the cables more rigid as a unit. This stiffness and rigidity allows a greater thrust to be put upon the attachment end during installation and makes installation easier for the operator.

Another object of the invention is to provide a superior mixing system to mix resinous materials in the borehole, especially where multi-cables serve as paddles to mix the resinous components and force the materials around the walls of the borehole but also force the mixed resinous components between cables to churn and thoroughly mix the components with a minimum number of rotations.

Another object of the invention is to provide a higher strength rock anchor by using several cables in the same borehole.

Another object of the invention is to provide a high strength rock anchor in a small diameter borehole through the use of high strength cables in a minimum quantity and thickness of resin.

Another object of the invention is to allow post tensioning of the cable in a multi-cable unit to further support the geologic material and develop active forces to resist geologic movements.

Another object of the invention is to eliminate the need to use couplings which are normally needed when using multi-length long rock anchors.

The foregoing and other objects of the invention will be set forth in details of the construction of the multiple cable rock anchors as seen in the several views of the drawings.

BRIEF DESCRIPTION OF THE EMBODIMENTS

The objects of the invention are carried out by embodiment shown in the following drawings, wherein.

Figure 13:
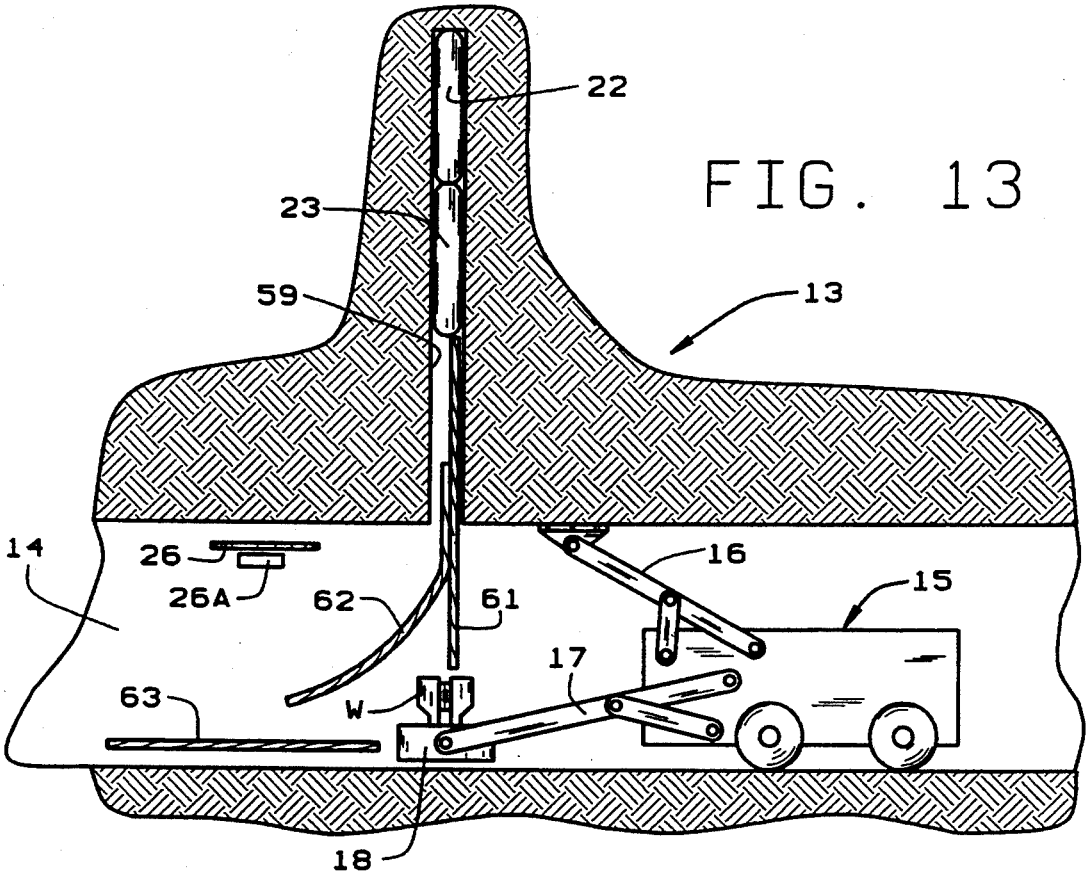
Figure 14:
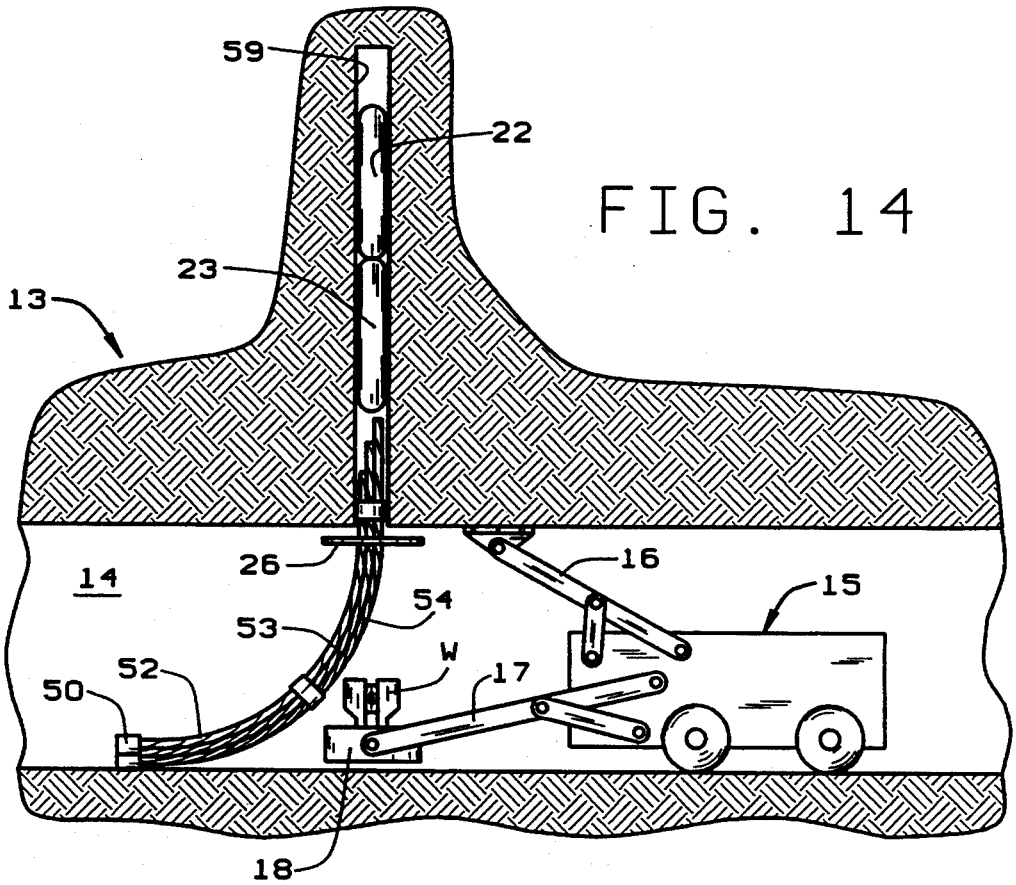

FIG. 13 is a schematic view of wrench to be used for inserting and spinning cables without cable end attachments in place. Length of wrench provides a standoff distance for cable ends which allows sufficient length to position roof plate, cable attachment and have ends of cable protrude to allow post tensioning of cables; and FIG. 14 is a further schematic view of the cable ends being inserted in the borehole with ends in uneven positions to allow easier piercing of the resinous material.

DETAIL DESCRIPTION OF THE EMBODIMENT

Figure 1:
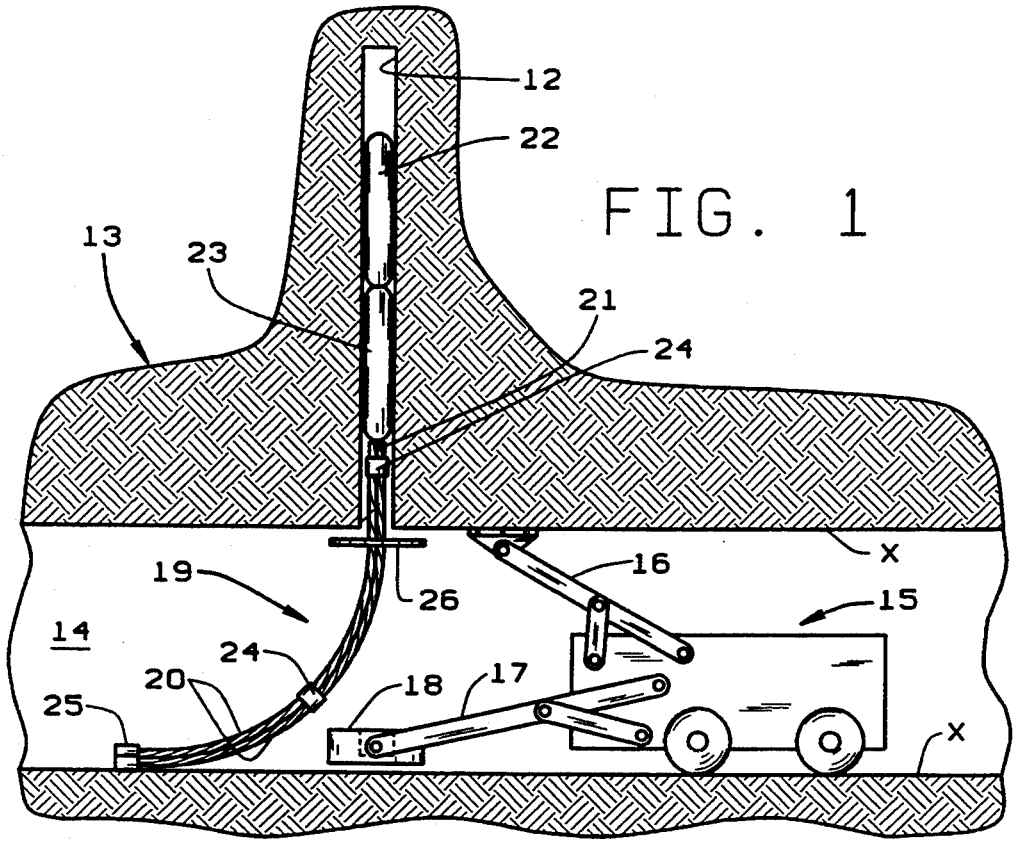
FIG. 1 is a schematic view of a mine passage in a geologic formation which is provided with a borehole to receive resinous materials in preparation for insertion of a multi-cable anchor by bending the anchor to allow for the operation of roof bolter apparatus.

With respect to FIG. 1, there is illustrated a borehole 12 formed in a geologic structure 13. A low ceiling passage 14 has been excavated in the structure 13 to accommodate a well known bolter mechanism 15 rolled into position so a ceiling support mechanism 16, and a rock anchor driving mechanism 17 carrying an anchor cable rotating head 18 so the anchor cables can be properly positioned. A multiple cable rock anchor 19 is shown being directed into the borehole 12 upon manually bending the multiple cables 20 so the leading ends 21 are inserted to push the resin containing cartridges 22 and 23 ahead of it. The multiple cables 20 are held in side-by-side positions by suitable tapes or straps 24, and the outer ends of these cables 20 are joined together in a unifying attachment 25 so the cables can be inserted substantially together even though the separate cables 20 are able to slide relative to each other as a result of the manual bending.

Figure 2:
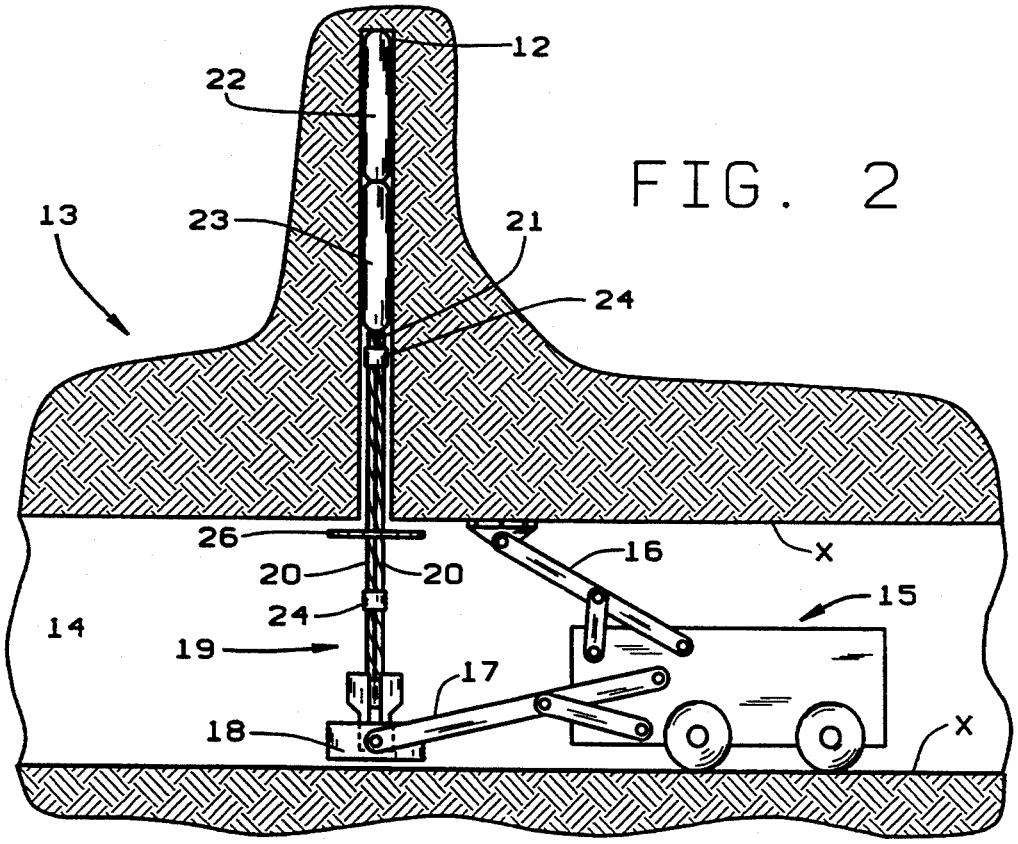
FIG. 2 is a further schematic view of the application of the bolter apparatus in position to spin the cable into position.

The view of FIG. 2 illustrates the installation of the multiple cable rock anchor 19 after it has been manually bent and maneuvered into the borehole 12 while pushing the capsules 22 and 23 ahead of its lead end 21. The multiple cables 20 need to be manually positioned so the wrench W in the drive head 18 can be engaged by the unifying attachment 25 (not shown). Before the cables 20 are moved into position a roof plate 26 must be added. Upon the cables 20 being rotated and pushed into the borehole 12 the unifying attachment 25 will be engaged under the plate 26 and retain it against the roof of the geologic structure 13. Since this final position of the multiple cable rock anchor 19 is well known to hold the plate 26 against the geologic structure 13, whether it is against a ceiling or other surface, it is not necessary to show it in the drawing.

Figure 3:
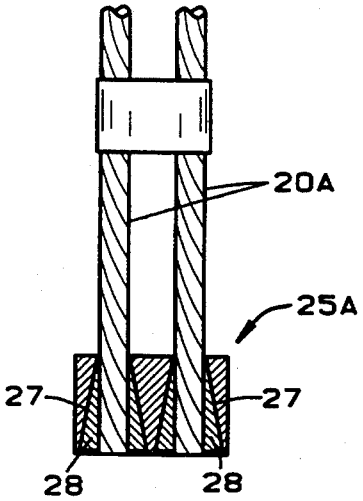
FIG. 3 is a schematic assembly of a multi-cable anchor assembled in a rigid attachment and cables held in position by frangible wraps.

Turning now to FIG. 3, there is seen an example of how a unifying attachment 25A is engaged upon the ends of a pair of cables 20A. The attachment 25A is formed with tapered bores 27 so a pair of wedges 28 can be accommodated in the bores 27 to firmly retain the cables 20A in the bores 27.

Figure 4:
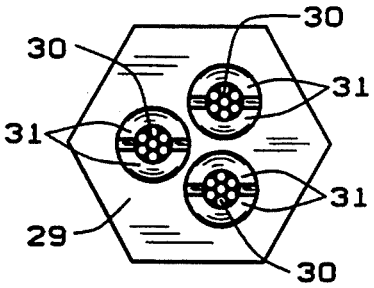
FIG. 4 is a modified unifying multiple cable attachment.

FIG. 4 illustrates a hexagonal unifying attachment 29 as seen from its end to show three 7-strand cables 30 secured in tapered bores which receive at least a pair of tapered wedges 31 to secure the respective cables, The hexagonal shape of the attachment 29 is so formed so it will fit into a similar socket in a driver brought in the apparatus 15 shown in FIG. 2.

Figure 5:
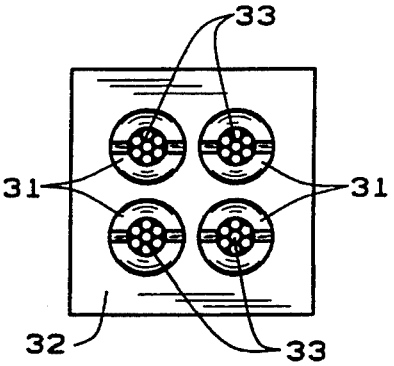
FIG. 5 is still another embodiment of a unifying multiple cable attachment.

FIG. 5 illustrates a modified square unifying attachment 32 to secure four separate cables 33 in position to be rotated into a unified cable. Tapered wedges 31 are again employed in suitable tapered bores.

Figure 6:
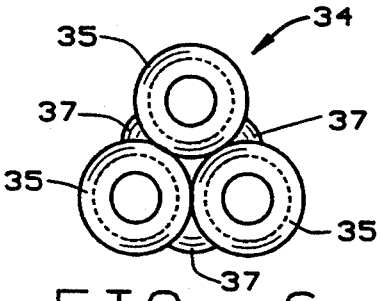
FIG. 6 is yet another embodiment of a unifying multiple cable attachment.
Figure 7:
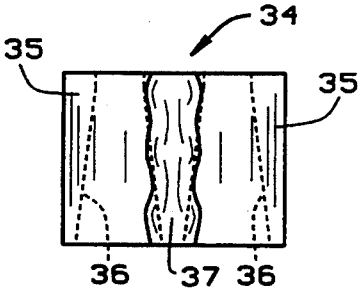
FIG. 7 is a side elevation view of the attachment seen in FIG. 6.

FIGS. 6 and 7 are end and side views respectively of a unifying attachment 34. In this form the attachment comprises three separate ferrules 35, each having a tapered bore 36 (FIG. 7) to accommodate a cable and its securing wedges similar to the treatment seen in FIG. 4. However, in the use of separate ferrules 35, they are united by suitable welds 37 as seen in FIG. 6. The shape of three ferrules will require a suitable driver to effect rotation thereof to bring individual cables into twisted cooperation.

Figure 8A:
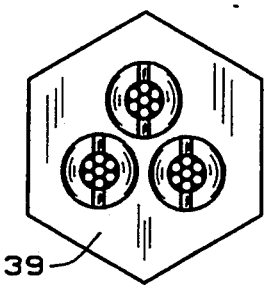
FIG. 8A is a view of FIG. 8 taken along line 8A—8A.
Figure 8:
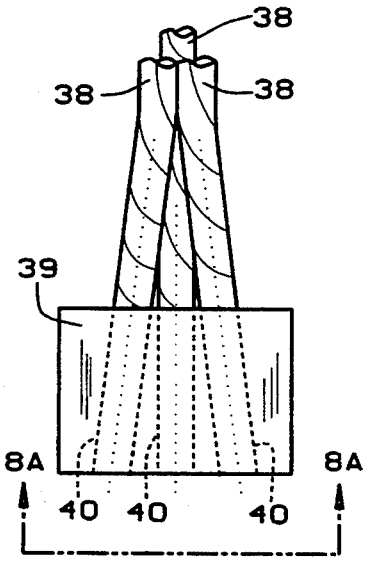
FIG. 8 is an exploded schematic view of an attachment for three cables in which the holes are angled to focus the cables into the center line of the borehole.

It is found to be advantageous to be able to bring the individual cables 38 into a focused association that is seen in FIG. 8. Here the unifying attachment body 39, as seen in FIG. 8A is formed with bores 40 that are angularly directed to bring the cables 38 into close adjacency, thereby resulting in a cable anchor that resembles a rod but is able to be manually bent for installation as seen in FIG. 1.

Figure 9A:
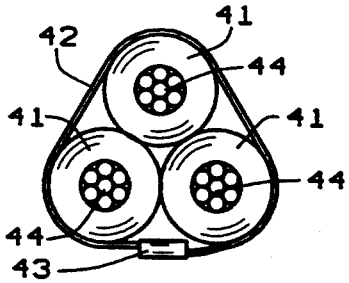
FIG. 9A is a section view of FIG. 9 taken along line 9A—9A.
Figure 9:
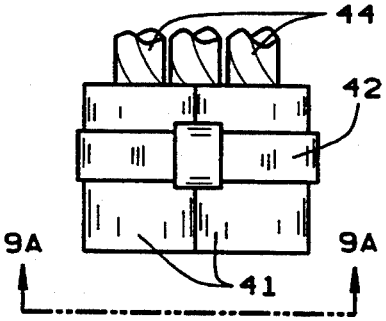
FIG. 9 is a further embodiment of a multi-cable attachment held in assembly by a strap.

The disclosure in FIG. 9 shows a variation of the use of multiple ferrule bodies 41, each having a tapered bore as seen, for example, in FIG. 8. However, in this modification it has been found to be more economical than welding as in FIG. 6, to employ a suitable strap 42, as seen in FIG. 9A having its ends joined at 43 to secure the ferrules 41 in proper position to join three cables 44.

Figure 10:
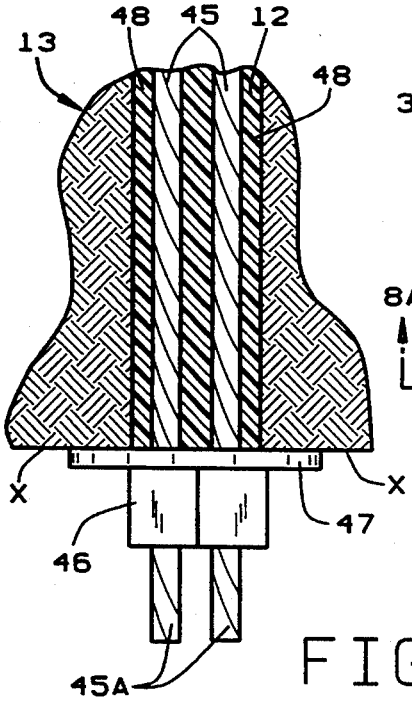
FIG. 10 is a schematic view of a multi-cable attachment providing exposed cable ends for permitting post tensioning of each cable.

The view of FIG. 10 illustrates the post tensioning condition where a pair of cables 45 in the borehole 12 of the geologic structure 13 are provided with extended ends 45A protruding from the unifying attachment 46 beyond the roof plate 47. In this form of installing the cables 45 have protruding ends 45A made long enough so that a pulling jack device of well known character can be attached to generate a desired tension load to press the plate 47 against the geologic structure. The fragmentary view of FIG. 10 is taken where the resinous material 48 has been allowed to fill the borehole along the length of the cables 45, although that may not be necessary in all cases.

Figure 11:
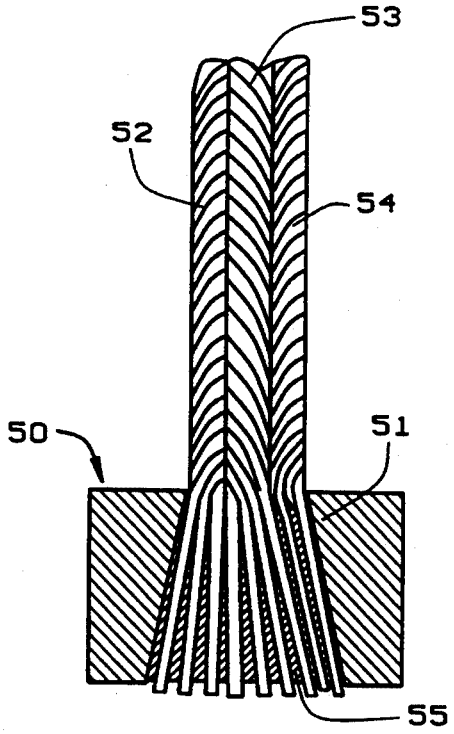
FIG. 11 is a view of the attachment for multiple cables in which a single tapered hole exists in the attachment and cables have the wires opened out so they are secured in place by poured hardenable liquid metal.
Figure 11A:
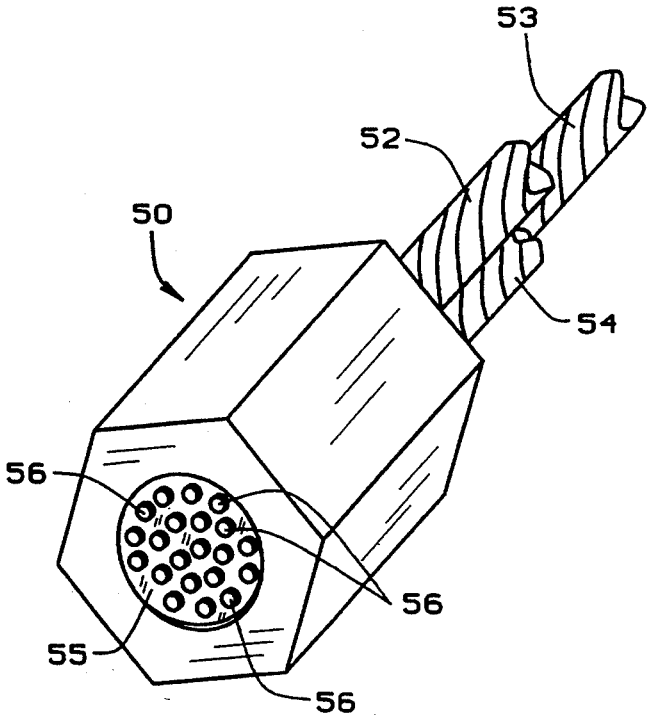
FIG. 11A is a perspective view of the multiple cable attachment device of FIG. 11.

The view of FIGS. 11 and 11A illustrate a cable unifying attachment 50 which is provided with a tapered bore 51 to receive a plurality of cables 52, 53 and 54. These cables are secured by the deposit of molten metal 55 in the bore 51 which upon solidification firmly secure the spread out wires 56 of the cables. The attachment 50 has a single tapered socket bore 51 so the individual cable wires can be partially untwisted to spread out the wires enough to allow the molten metal to flow into the spaces and surround the spread out wires to set up and form a solid body with the cable wires embedded in the metal 55. The introduction of the molten metal is effected while the attachment is held with its wide end upwards.

Figure 12:
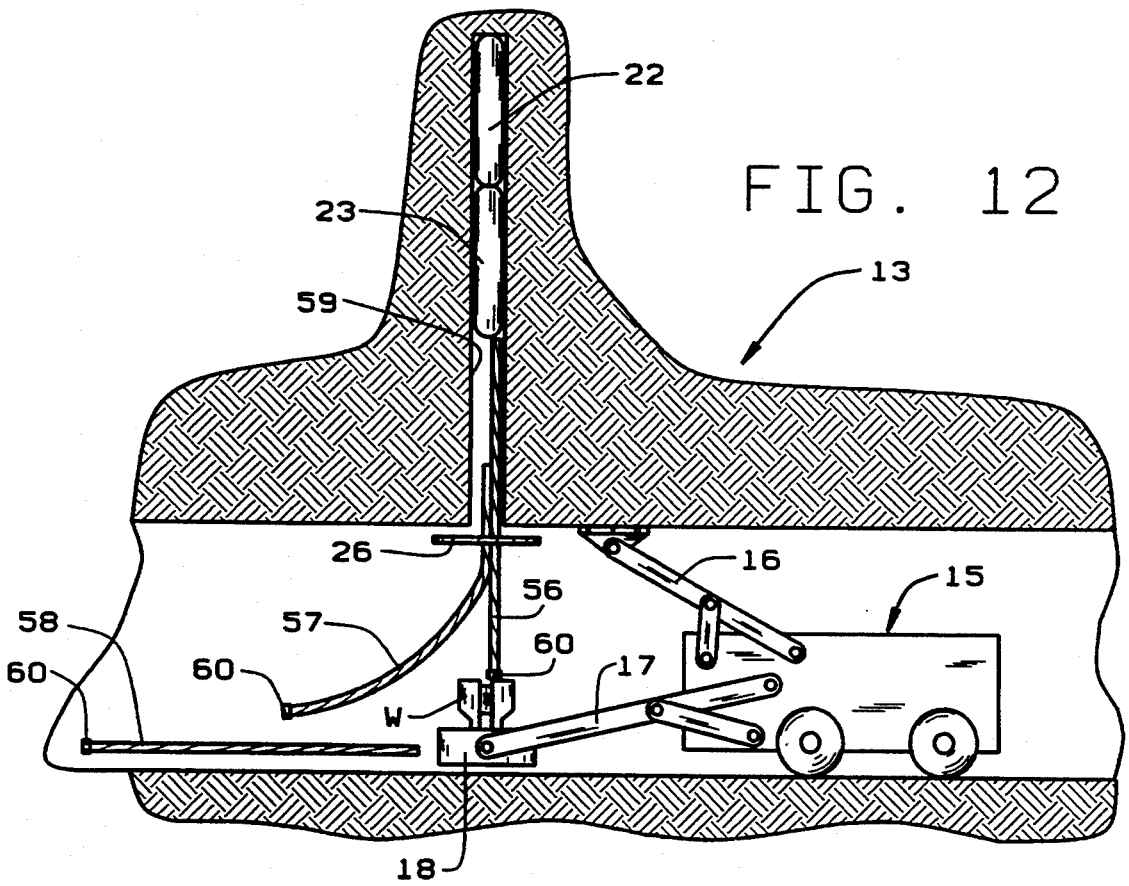
FIG. 12 is a schematic view of separate and distinct cables being inserted into a borehole as separate operations to a position where all cable attachments can be placed in a common wrench attached to a rotation motor to allow spinning and insertion of all cables as a single unit.

In FIG. 12, the separate cables 56, 57 and 58 are manually pushed up through the roof plate 26 and into the borehole 59 after the cartridges 22 and 23 have been inserted. In this view, the cables have end attachments 60 already in place which facilitates the retention of the roof plate 26. The manual insertion of the cables will allow the individual end attachments to be placed in the wrench W so that spinning of the wrench will twist the cables 56, 57 and 58 into a stiff cable in a rod-like assembly with the resinous materials in the cartridges mixed and stirred into the cables to obtain a secure bond of the cables with the borehole.

FIG. 13 illustrates a further embodiment of the anchor system in which the bolter mechanism 15 is positioned to insert the individual cables 61, 62 and 63 in the borehole 12 after the resin cartridges 22 and 23 have been inserted. Each cable is inserted in advance of the placement of a roof plate 26 and its retainer member 26A. After the plain ends of the respective cables have been placed in the wrench they are then spun into the borehole 59 and secured by the member 26A with the roof plate 26 against the roof. In this view the cables 61, 62 and 63 can be of different lengths to aid in piercing the cartridges and effecting resinous anchorage over a longer dimension of the borehole. When an increase in the strength of the anchor is desired, individual cables can be selected of different diameters and assembled in the same borehole. It is also a feature of the anchorage system to select cables having differing strength steel wires of the same cable diameters anchored in the same borehole.

In FIG. 14, the anchor cable system in the borehole 59 includes cartridges 22 and 23 pushed into the borehole 59 in advance of insertion of a group of three cables 52, 53 and 54 which have been secured in the attachment 50 shown in FIGS. 11 and 11A. In this view, the cable 53 is shown to be of a larger diameter than cables 52 and 54, the difference in diameter is best seen in FIGS. 11 and 11A.

The foregoing description relates to a multi-cable rock anchor system for support and stabilization of geologic formations in and around rock excavations. The cables are anchored in boreholes 12 with cementeous or resinous material cartridges 22, 23 placed in the borehole 12 previous to cable insertion. The ends of the cables protruding from the borehole are jointly secured in a common unifying retainer attachment 25 which provides a retention for a plate 26 or other means to have the tension in the cables hold the rock surface material in place and provide a strengthening means to the geologic mass. The resinous or cementeous anchor material may only partially fill the borehole 12, providing a point anchor for the cables, or sufficient material may be placed in the borehole to completely fill the annulus area around the cable, as in FIG. 10, providing a full contact anchor. The cables are rotated upon insertion to mix the anchor components and to aid in penetrating the anchor material. In the case of resinous anchor means, the resin and catalyst are fully mixed by the rotation process. Rotation also serves to twist the cables to form a stiffer, unified cable system which aids in insertion and serves to force resin up the borehole and mix the resinous material in the borehole, or to push it into the borehole in the first instance, and at the same time, mix the individual components. Resinous cartridges that have different setting times may be used to aid installation and to allow quick setup of a portion of the anchor length so that the time of thrust holding can be quite short, such as 15 to 30 seconds. The slow set resin would be used near the collar of the borehole and the fast set resin at the bottom or back end of the borehole. Using multi-cables provides a rock anchor of high strength. As more cables are used, overall strength of the rock anchor increases proportionately. Also, using multi-cables to obtain high strength but allowing slippage between cables makes bending of the cables outside the borehole easier than if a single large diameter wire rope were used to achieve the same fixture strength. While the cables are fixed to a common unifying attachment unit which holds them rigidly in place, the cables should be loosely attached or banded to each other at places along their length to allow relative sliding to occur between cables as the cables are readily bent for installation when long cable anchors are placed in low ceiling underground excavations, or in passages having a space the dimension of which is less than the length of the multiple cable assembly so that the cable must be bent to enable feeding it into the borehole.

The multiple cable rock anchor presents a unique method by which it can be fed into a borehole, and that arises by reason of an excavated passage in a geologic structure may have a limited space dimension in which to manipulate the multiple cables. Hence, bending the cables is necessary. Thus the invention herein can be manipulated in a unique method even though the multiple cables form a unique rock anchor product for practicing the method.

What is claimed is:

1. A multiple cable rock anchor method for stabilizing geologic structure in an exposed surface in an excavated passage in the geologic structure, the method comprising the steps of:

a) forming a borehole in the exposed surface with an opening in the excavated passage;

b) placing resinous material containing cartridges in the borehole;

c) assembling a plurality of individual cables in which each of the cables is made up of multi-strands and the cables are positioned in side-by-side positions;

d) securing a first end of each of said individual cables in a common fixture;

e) feeding second ends of said cable substantially simultaneously into the borehole;

f) forcing the cables of the multi-cable assembly into the borehole and applying the multi-cable assembly to push the resinous containing cartridges into the back of the borehole; and g) rotating the assembly of the plurality of cables in the resinous material to mix the material and distribute the resin material between said cables and effectively mix and set the resin material assembly in the geologic structure.

2. The method set forth in claim 1 wherein the excavated passage has a first vertical dimension and the multi-cable assembly has a length greater than the first vertical dimension of the passage.

3. The method set forth in claim 1 wherein said individual cables making up the assembly are capable of being manipulated within the excavated passage for feeding into the borehole.

4. The method set forth in claim 1 wherein bending of the cable assembly permits manipulation thereof.

5. The method set forth in claim 1 wherein the cables in the assembly are slidable relative to each other while being placed in bending.

6. A multiple cable anchor for insertion in a borehole formed in a geologic formation comprising, in combination:

a) a plurality of individual elongated cables having multi-strands in each thereof, said multi-strand cables being assembled in side-by-side positions and having first ends positioned adjacent each other for entry into the borehole and opposite ends thereof;

b) a geologic formation support plate carried by said plurality of assembled elongated cables;

c) resinous material positioned in the borehole; and d) apparatus for engaging and forcing said first ends of said assembled cables into the borehole with said assembled cables being rotated for mixing the resinous material to effect penetration into said cable strands and retaining said cables in said borehole to hold said support plate against the geologic formation.

7. The multiple cable anchor set forth in claim 6 wherein said elongated cables are twisted together to form a tight configuration embedded in said resinous material.

8. The multiple cable anchor set forth in claim 6 wherein said individual elongated cables have different lengths.

9. The multiple cable rock anchor set forth in claim 6 wherein said individual elongated cables are of unequal strengths.

10. The multiple cable rock anchor set forth in claim 6 wherein said individual elongated cables have different diameters.

11. The multiple cable rock anchor set forth in claim 6 wherein said individual elongated cables have different strength in tension.

12. The multiple cable anchor set forth in claim 6 wherein said opposite ends of said cables project beyond said support plate to allow tension adjustments in each of said cables.

13. The multiple cable anchor set forth in claim 6 wherein an attachment device retains said opposite ends of said cables in said adjacency.

14. The multiple cable anchor set forth in claim 13 wherein said apparatus engages and rotates said attachment device for twisting said cables to pump and mix the resinous material in the borehole.

15. A cable anchor assembly for stabilizing a geologic roof formation exposed in an excavated passage in the geologic formation, the cable anchor assembly positioned in a borehole and comprising:

a) a plurality of cables, each having multi-strands, assembled together for positioning in a borehole, said cables having leading ends;

b) means retaining said plurality of cables in assembly with said leading ends directing the cable assembly into the borehole;

c) cartridge means in the borehole in position to be engaged by the cable leading ends to propel the cartridge means into said borehole, said cartridge means having resin for release in the borehole by the engagement of said cable leading ends to anchor the cable assembly in the borehole; and d) roof formation support plate means secured in position by said cable assembly.

16. The cable anchor assembly of claim 15 wherein said cable leading ends are staggered.

17. The cable anchor assembly of claim 15 wherein said cable assembly includes individual multi-strand cables having different diameters.

18. The cable anchor assembly of claim 15 wherein said cable assembly includes individual multi-strand cables having different load sustaining strengths.

* * * * *